US012004637B2

(12) United States Patent
Perrault

(10) Patent No.: US 12,004,637 B2
(45) Date of Patent: Jun. 11, 2024

(54) WATER BOTTLE SEAT

(71) Applicant: Jackson Langseth Perrault, Apple Valley, MN (US)

(72) Inventor: Jackson Langseth Perrault, Apple Valley, MN (US)

( * ) Notice: Subject to any disclaimer, the term of this patent is extended or adjusted under 35 U.S.C. 154(b) by 159 days.

(21) Appl. No.: 17/734,596

(22) Filed: May 2, 2022

(65) Prior Publication Data

US 2022/0378180 A1 Dec. 1, 2022

Related U.S. Application Data

(60) Provisional application No. 63/192,668, filed on May 25, 2021.

(51) Int. Cl.
*A45F 4/00* (2006.01)
*A45F 3/18* (2006.01)
*B65D 51/24* (2006.01)

(52) U.S. Cl.
CPC ..... *A45F 4/00* (2013.01); *A45F 3/18* (2013.01); *B65D 51/24* (2013.01)

(58) Field of Classification Search
None
See application file for complete search history.

(56) References Cited

U.S. PATENT DOCUMENTS 2,919,169 A * 12/1959 Jackson ..... A47J 47/02 297/188.09
3,751,845 A * 8/1973 van Leeuwen ..... A01K 97/05 D22/136
4,142,756 A * 3/1979 Henning ..... B60K 15/0406 220/288
4,295,680 A * 10/1981 Grasso ..... A45C 11/20 297/188.09
4,440,306 A * 4/1984 Van Buskirk ..... B65D 55/02 215/230
5,003,790 A * 4/1991 Goupil ..... B67D 1/0009 210/474
5,586,805 A * 12/1996 Rinehart ..... A01K 97/22 297/188.1
5,715,959 A * 2/1998 Pfefferkorn ..... B65D 41/3447 215/256

(Continued)

FOREIGN PATENT DOCUMENTS

DE 2351988 A1 * 5/1974
DE 3328158 A1 * 2/1985

(Continued)

OTHER PUBLICATIONS

Applicant submitted prior art from World Design Guide containing a screenshot of a Bottle Chair for children, captured May 5, 2021 from worlddesignguide.com (website inactive).

*Primary Examiner* — David E Allred
(74) *Attorney, Agent, or Firm* — Brian D. Kaul; Westman, Champlin & Koehler, P.A.

(57) ABSTRACT

A water bottle seat includes a water bottle cap including a cap body that is configured to attach to a water bottle body, and a seat platform that is attached to the water bottle body. The cap body has a central axis. The seat platform extends in a plane that is transverse to the central axis, and the seat platform extends radially from the central axis a greater distance than the water bottle cap.

23 Claims, 8 Drawing Sheets

(56) References Cited

U.S. PATENT DOCUMENTS

| | | | | |
|---|---|---|---|---|
| 5,718,494 | A * | 2/1998 | Luddemann | G09F 15/0043 312/258 |
| 6,135,275 | A * | 10/2000 | Kelders | B65D 81/3211 215/DIG. 8 |
| 6,783,015 | B1 * | 8/2004 | Bosl | B65D 41/3442 215/349 |
| 7,055,907 | B1 * | 6/2006 | Tilby | A01M 31/02 297/382 |
| 2007/0204726 | A1 * | 9/2007 | Burton | B67B 7/18 81/3.4 |
| 2016/0107808 | A1 * | 4/2016 | Forsyth | B65D 51/1633 220/253 |
| 2016/0288967 | A1 * | 10/2016 | Isogai | B65D 47/36 |
| 2017/0020294 | A1 * | 1/2017 | Beneduce | A47C 7/42 |
| 2019/0090627 | A1 * | 3/2019 | Lim | F16B 12/48 |
| 2021/0188501 | A1 * | 6/2021 | Krafft | B65D 51/24 |

FOREIGN PATENT DOCUMENTS

| | | | | |
|---|---|---|---|---|
| EP | 1088684 | A2 * | 4/2001 | B60B 7/0013 |
| FR | 2339948 | A1 * | 8/1977 | |

* cited by examiner

WATER BOTTLE SEAT

CROSS-REFERENCE TO RELATED APPLICATION

The present application is based on and claims the benefit of U.S. provisional patent application Ser. No. 63/192,668, filed May 25, 2021, the content of which is hereby incorporated by reference in its entirety.

FIELD

Embodiments of the present disclosure relate to transportable seating and, more specifically, to a transportable seat that is formed using a water bottle.

BACKGROUND

People commonly utilize transportable seating, such as when viewing or participating in outdoor activities, for example. The most common transportable seating option is a folding chair that may be carried in a bag. These chairs are generally bulky and consume a large amount of the user's carrying capacity, which may already be limited by other items, such as a water bottle.

SUMMARY

Embodiments of the present disclosure relate to a highly transportable water bottle seat formed by a platform that attaches to a water bottle. Since a typical user will have a need for carrying a water bottle, their carrying capacity is only decreased by the platform. As a result, the water bottle seat in accordance with embodiments of the present disclosure is very compact relative to conventional transportable seating, and highly transportable.

One embodiment of the water bottle seat includes a water bottle cap including a cap body that is configured to attach to a water bottle body, and a seat platform that is attached to the water bottle body. The cap body has a central axis. The seat platform extends in a plane that is transverse to the central axis, and the seat platform extends radially from the central axis a greater distance than the water bottle cap.

Another embodiment of the water bottle seat includes a water bottle body, a water bottle cap, and a seat platform. The water bottle body includes an interior cavity, a bottom end, a top end opposite the bottom end, and a cavity opening to the interior cavity at the top end. The water bottle cap includes a cap body that is removably attachable to the top end of the water bottle body adjacent the cavity opening, a central projection extending from the cap body along the central axis, and first and second connector projections each extending radially from the central projection relative to the central axis in opposite directions. The seat platform includes a top side, a bottom side, a receptacle formed in the bottom side and extending toward the top side, first and second keyed openings extending radially from the receptacle in opposite directions, a first shoulder at the bottom side extending around a perimeter of the receptacle from the first keyed opening, and a second shoulder at the bottom side extending around the perimeter of the receptacle from the second keyed opening. Insertion of the central projection, the first connector projection, and the second connector projection respectively through the receptacle, the first keyed opening and the second keyed opening, and rotation of the seat platform relative to the water bottle cap about the central axis, positions the first shoulder between the first connector projection and the cap body and the second shoulder between the second connector projection and the cap body and attaches the seat platform to the water bottle cap. When the seat platform is attached to the water bottle cap, the seat platform extends transversely to the central axis, and the seat platform extends radially from the central axis a greater distance than the water bottle body and the water bottle cap.

Another embodiment is directed to a method of assembling a water bottle seat, which includes a water bottle body, a water bottle cap and a cap body. The water bottle body includes an interior cavity, a bottom end, a top end opposite the bottom end, and a cavity opening to the interior cavity. The water bottle cap includes a cap body and a first connector attached to the cap body. The seat platform includes a second connector. In the method, the water bottle cap is attached to the top end of the water bottle body, such that the water bottle cap covers the cavity opening. The seat platform is attached to the cap body using the first and second connectors, wherein the seat platform extends in a plane that is transverse to a central axis of the cap body, and the seat platform extends radially from the central axis a greater distance than the water bottle body and the water bottle cap.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the Background.

DETAILED DESCRIPTION OF ILLUSTRATIVE EMBODIMENTS

Figure 1:
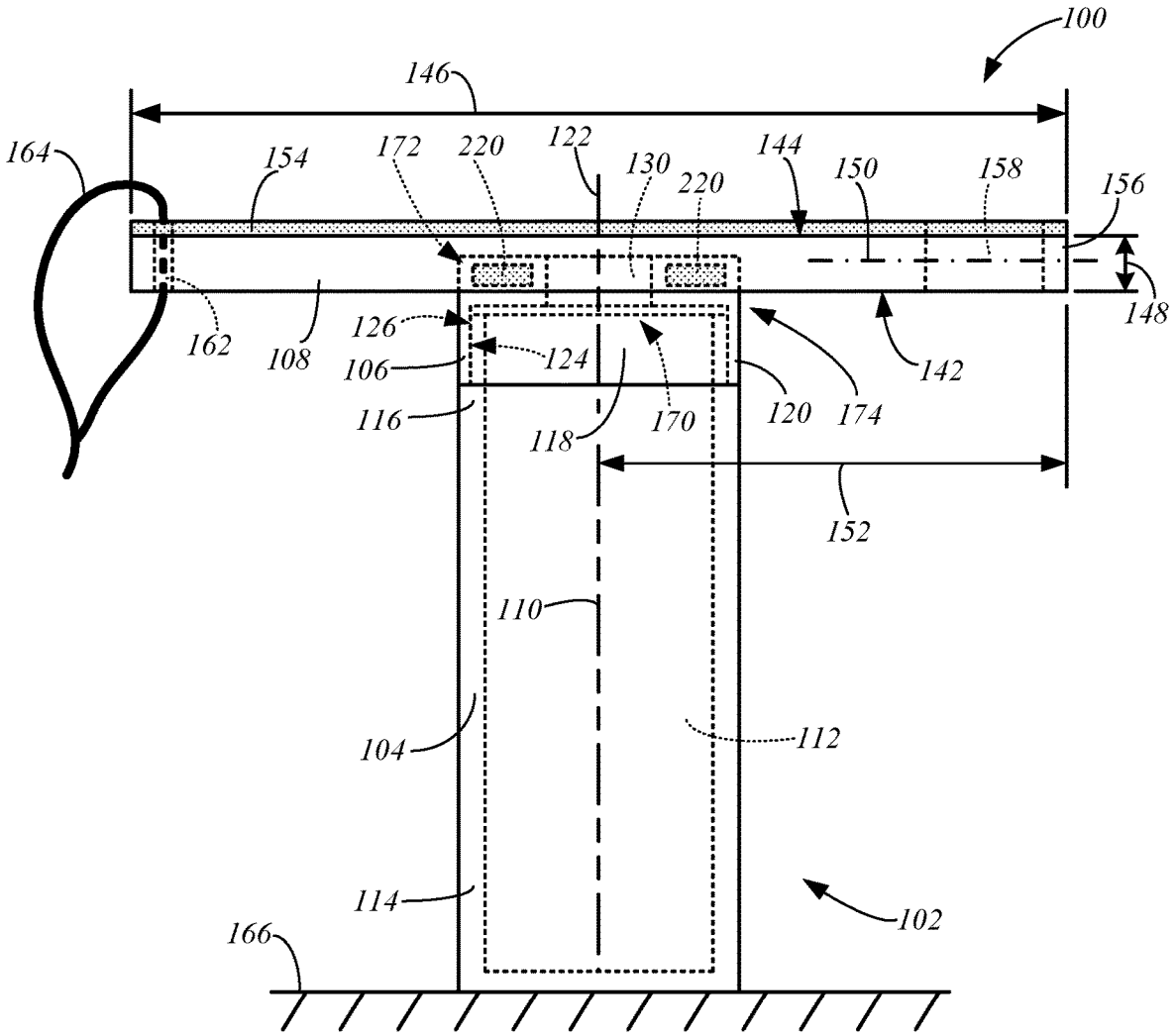
FIG. 1 is a simplified side view of a water bottle seat, in accordance with embodiments of the present disclosure.

Embodiments of the present disclosure are described more fully hereinafter with reference to the accompanying drawings. Elements that are identified using the same or similar reference characters refer to the same or similar elements. The various embodiments of the present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art.

Figure 2:
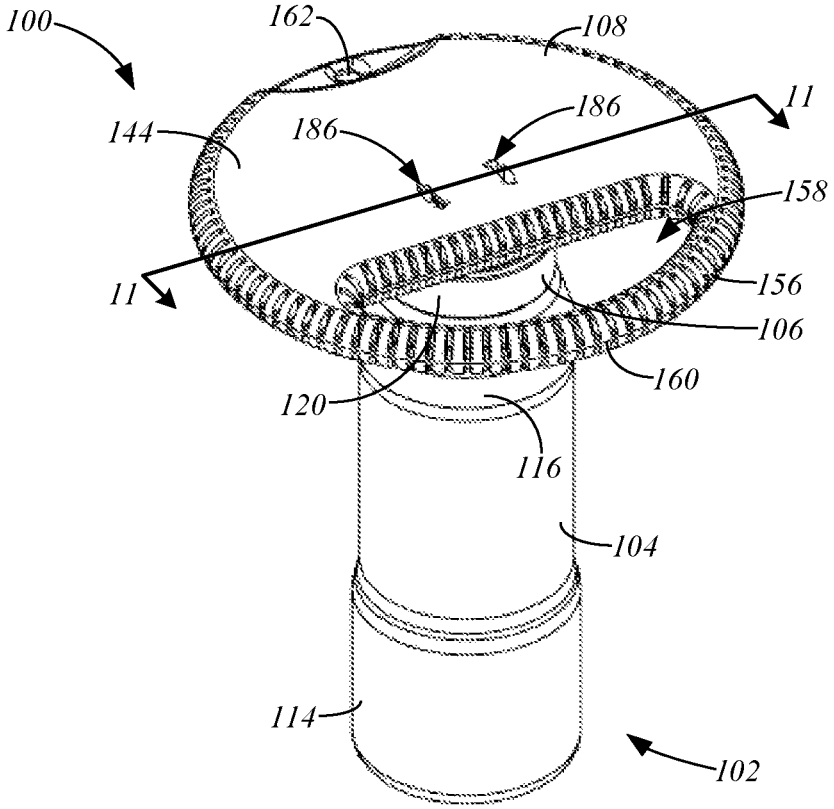
FIGS. 2 and 3 are top and bottom isometric views of an example of the water bottle seat of FIG. 1, in accordance with embodiments of the present disclosure.
Figure 3:
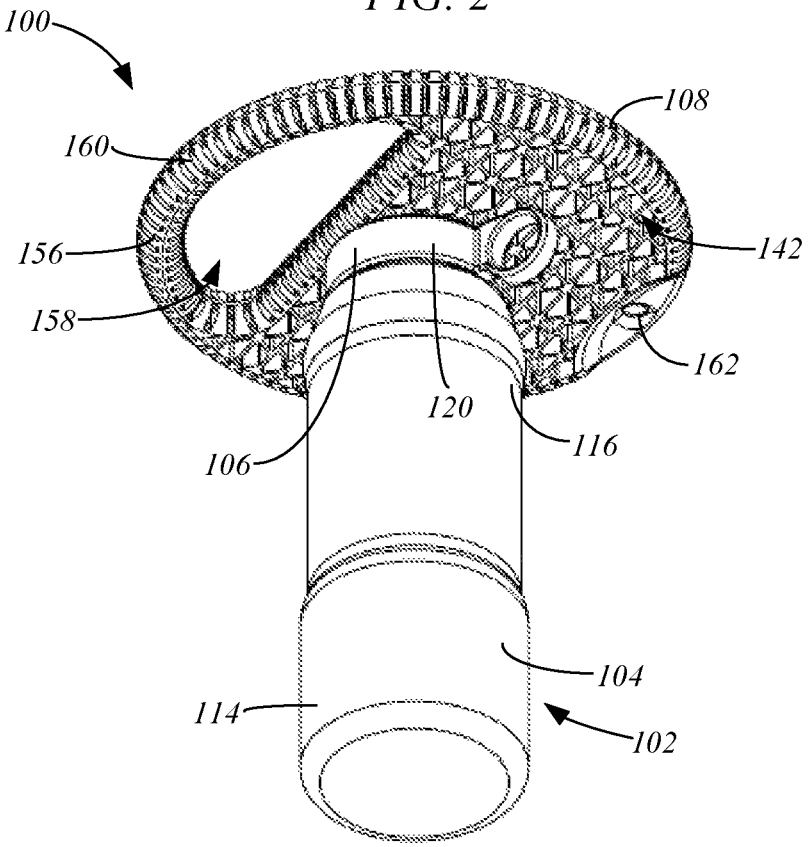
Figure 4:
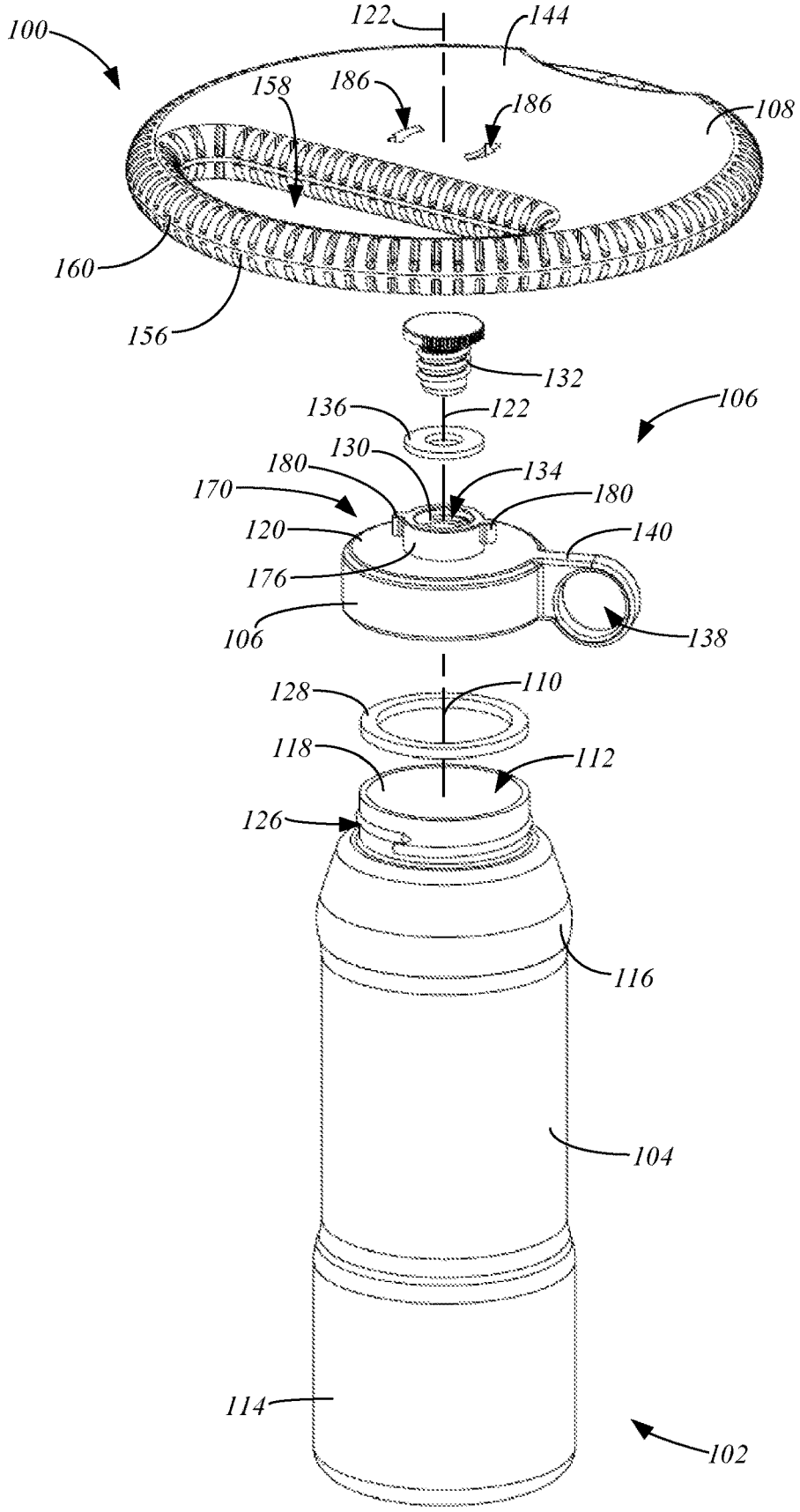
FIGS. 4 and 5 are front exploded isometric and front views of the water bottle seat of FIGS. 2 and 3, in accordance with embodiments of the present disclosure.
Figure 5:
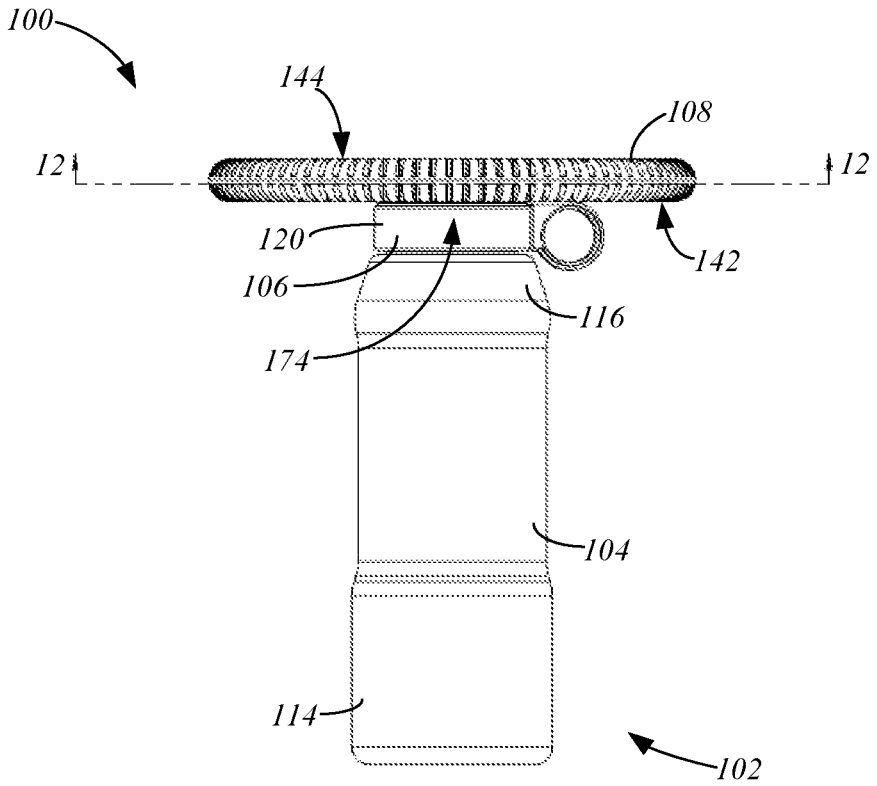

FIG. 1 is a simplified side view of a water bottle seat 100, in accordance with embodiments of the present disclosure. An example of the water bottle seat 100 is illustrated in FIGS. 2-5. FIGS. 2 and 3 are top and bottom isometric views of the assembled water bottle seat 100, FIG. 4 is a front exploded isometric view of the water bottle seat 100 of FIGS. 2 and 3, and FIG. 5 is a front view of the water bottle seat 100 of FIGS. 2 and 3, in accordance with embodiments of the present disclosure.

The water bottle seat 100 generally includes a water bottle 102 comprising a water bottle body 104 and a water bottle cap 106, and a seat platform 108 that attaches to the water bottle cap 106. When assembled, a user is able to sit on a top surface of the platform 108. The seat 100 may be configured to support up to 250 lbs. or more.

Since users are likely to carry a water bottle when using transportable seating, the seat 100 of the present disclosure provides a highly transportable seat that only requires the user to further carry the small seat platform 108. This burden is much smaller than when more conventional transportable seating is used, such as a foldable chair, which requires the user to carry both the entirety of the transportable seat and the water bottle. Accordingly, the water bottle seat 100 provides highly transportable seating that imposes a minimal carry burden on the user relative to that imposed by conventional transportable seating.

Embodiments of the present disclosure include the complete seat 100, such as in a fully assembled form, or in a fully or partially disassembled form. Additional objects of the present disclosure include the water bottle cap 106, the seat platform 108, and the combination of the seat platform 108 and the water bottle cap 106, each formed in accordance with one or more embodiments of the present disclosure. Additional embodiments include methods of assembling and using the water bottle seat 100. Thus, claims of the present application may be directed to each of these embodiments.

The water bottle body 104 may take on a conventional form and include a central axis 110, an interior cavity 112, a bottom end 114, a top end 116 opposite the bottom end 114, and a cavity opening 118 to the interior cavity 112 at the top end 116, as shown in FIGS. 1 and 4. The water bottle body 104 is capable of withstanding the anticipated compressive forces caused by a person sitting on the platform 108 of the assembled seat 100. As a result, a conventional disposable water bottle body formed of thin, collapsible plastic, would generally not be suitable as the water bottle body 104. The water bottle body 104, and may be formed of plastic, aluminum, stainless steel, or another suitable material. In some embodiments, the water bottle body 104 may comprise a double walled cylinder.

The water bottle cap 106 generally includes a cap body 120 having a central axis 122 that may be substantially concentric (e.g., within 0.25 inch) to the central axis 110 of the water bottle body 104 when the cap body 120 is secured to the water bottle body 104, as indicated in FIG. 1. The cap body 120 may be removably attachable to the top end 116 of the water bottle body 104 to cover and/or seal the cavity opening 118, in accordance with conventional water bottle caps 106, as shown in FIGS. 1 and 3.

Figure 6:
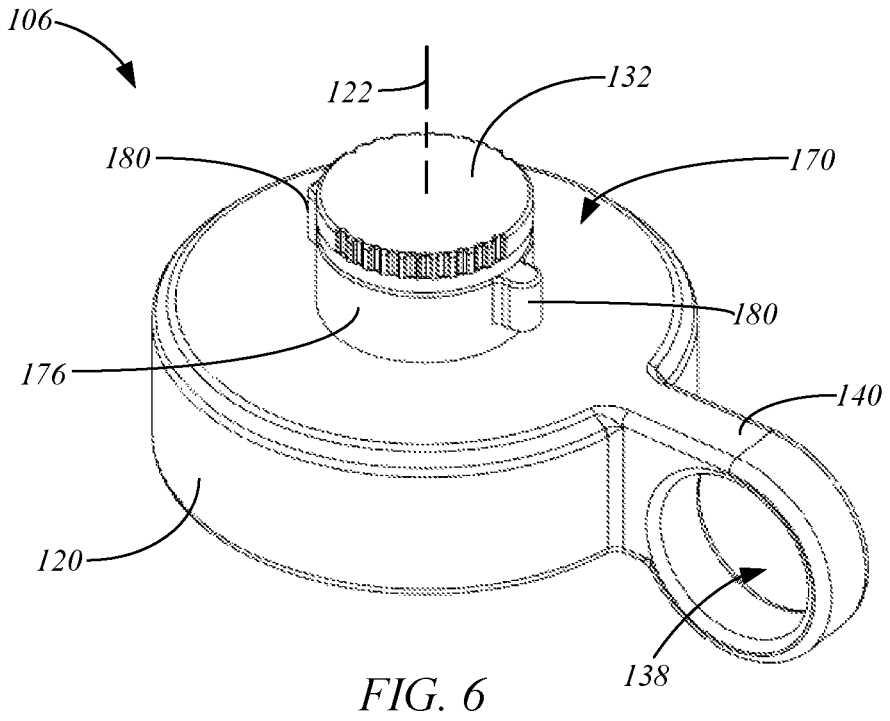
FIGS. 6 and 7 are top isometric and side views of an example of a water bottle cap, in accordance with embodiments of the present disclosure.
Figure 7:
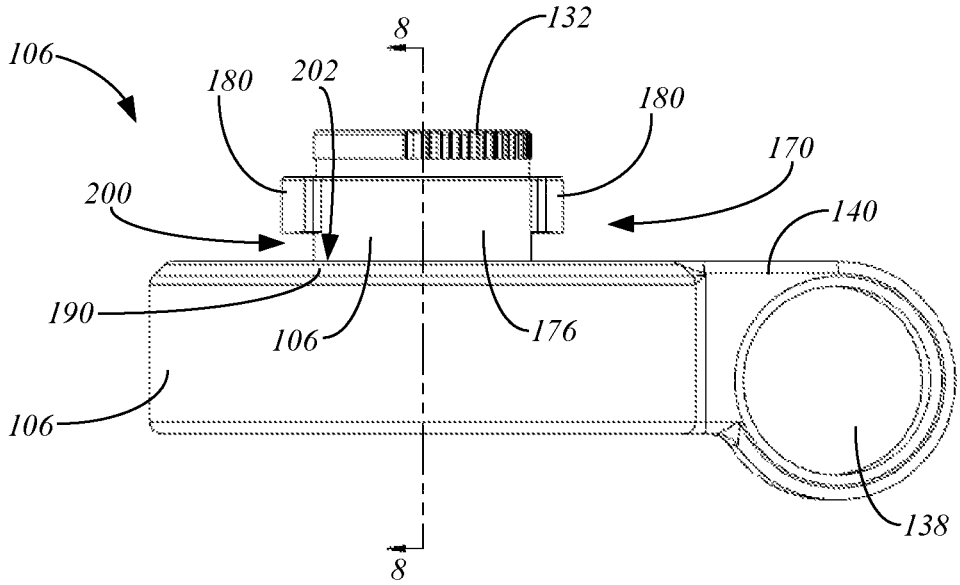
Figure 8:
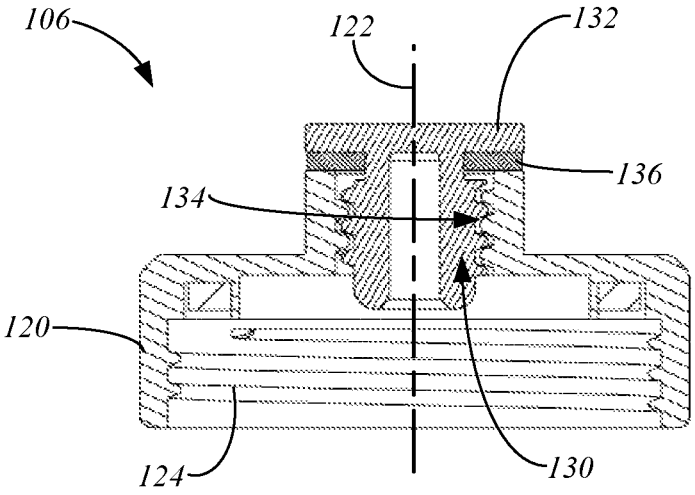
FIG. 8 is a cross-sectional view of the water bottle cap of FIG. 7 taken generally along line 8-8, in accordance with embodiments of the present disclosure.

FIGS. 6 and 7 are a top isometric view and a side view of an example of the water bottle cap, in accordance with embodiments of the present disclosure. FIG. 8 is a cross-sectional view of the water bottle cap of FIG. 7 taken generally along line 8-8, in accordance with embodiments of the present disclosure.

The cap body may include a threaded interior cylindrical wall 124 (FIGS. 1 and 8) that may be screwed to a corresponding threaded exterior wall 126 (FIGS. 1 and 4) of the water bottle body 104. The threaded cylindrical wall 124 may be concentric to the central axis 122 of the cap body 120, and the threaded exterior wall 126 may be concentric to the central axis 110 of the water bottle body 104. An O-ring or gasket 128 (FIG. 4) may be pinched between the cap body 120 and the water bottle body 104 to seal the cavity opening 118.

The water bottle cap 106 may include a fluid passageway 130 that extends through the cap body 120 and provides access to liquid contained in the interior cavity 112 of the water bottle body 104, as shown in FIGS. 1 and 8. A suitable sealing mechanism or component 132, such as a valve or a plug, may be used to open or close (e.g., seal) the fluid passageway 130. For example, the fluid passageway 130 may include a threaded interior wall 134 that is configured to receive a threaded plug 132, as indicated in FIGS. 4 and 8. An O-ring or gasket 136 may be pinched between the plug 132 and the cap body 120 to assist in sealing the fluid passageway 130, as shown in FIG. 8.

The water bottle cap body 120 may also include conventional components. In one example, the cap body 120 includes an aperture 138 (FIG. 6), to which a carabiner, a strap or another element may be connected. The aperture 138 may be formed in a tab 140 that extends from the cap body 120.

Figure 9:
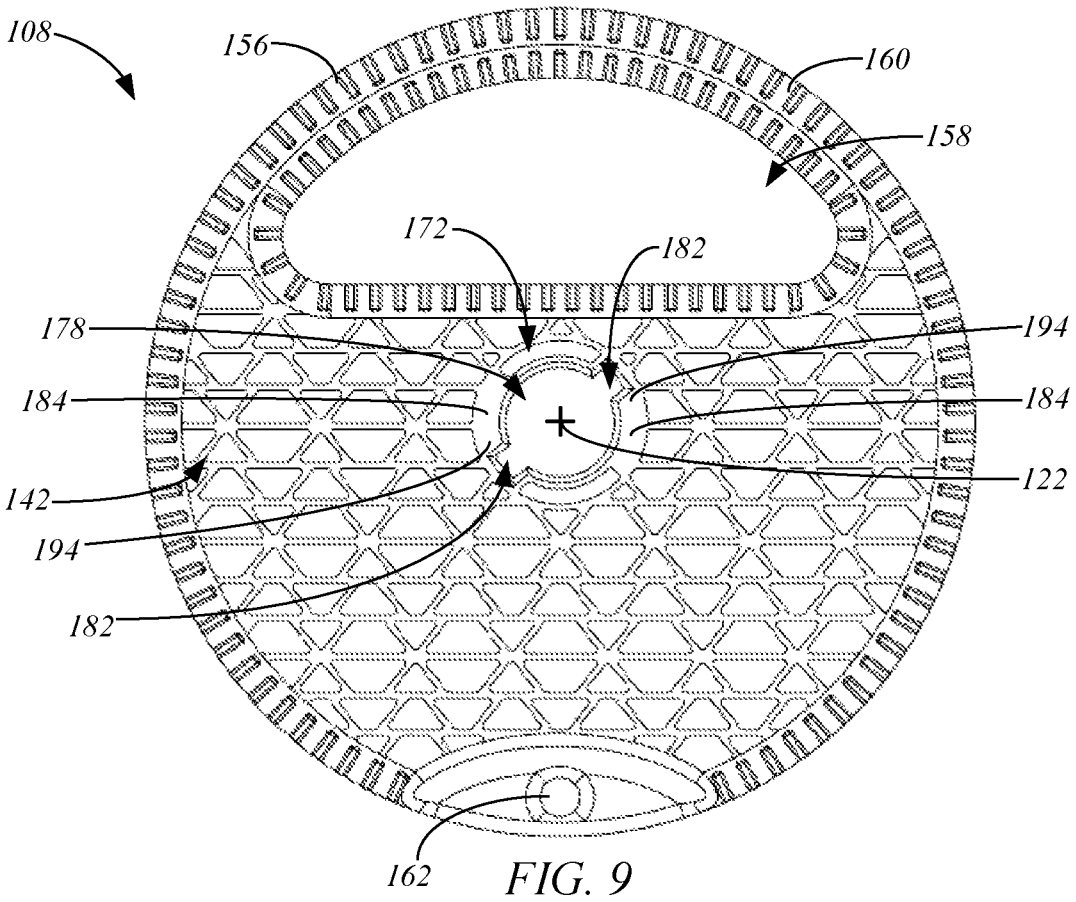
FIG. 9 is a bottom view of an example of a seat platform, in accordance with embodiments of the present disclosure.
Figure 10:
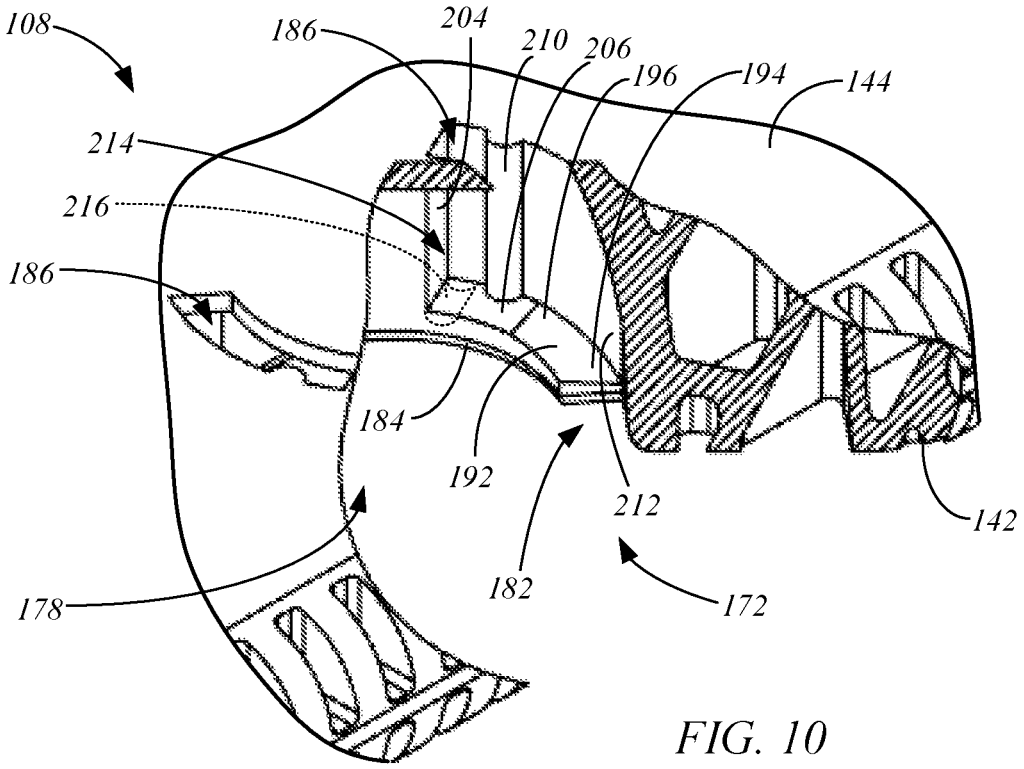
FIG. 10 is a top isometric partial cutaway view of a central portion of the seat platform of FIG. 2, in accordance with embodiments of the present disclosure.

Embodiments of the platform 108 will be described with reference to FIGS. 9 and 10. FIG. 9 is a bottom view and FIG. 10 is a top isometric partial cutaway view of a central portion of the seat platform 108 of FIG. 2, in accordance with embodiments of the present disclosure. The platform 108 is a rigid frame that may be formed of any suitable material, such as plastic, aluminum, stainless steel, and/or another suitable material. In some embodiments, the platform 108 includes structural features that enhance its rigidity while allowing the platform 108 to be lightweight. Examples of such structural features include ribs or a honeycomb structure, such as on a bottom side 142 (FIG. 9), which is opposite a top side or surface 144, on which a user sits.

The platform 108 may take on any suitable shape, such as circular, square, irregular or another desired shape. In one embodiment, the seat platform has a substantially circular shape and dimensions that resemble a disc golf disc. For example, the diameter 146 (FIG. 1) of the platform 108 may be about 5-12 inches, such as 6-11 inches or 7-9 inches. In one embodiment, the seat platform 108 has a diameter of about 8.5 inches (e.g., +/− 0.5 inch).

The thickness 148 (FIG. 1) of the seat platform 108 measured between the top surface 144 and the bottom surface 142 may be selected based on its materials and design. In one example, the thickness ranges from 0.5-2.0 inches, such as 0.75-1.0 inch. When the seat platform 108 is sized in accordance with disc golf discs, it may be easily carried alongside disc golf discs in conventional disc golf disc carriers, such as disc caddies and disc backpacks, which further reduces the carry burden imposed on the user.

When attached to the cap body 120, a plane 150 of the seat platform 108 extends transversely to the central axis 122, such as substantially perpendicularly (e.g., +/− 15 degrees) to the central axis 122. Additionally, when the seat 100 is assembled, the seat platform 108 extends radially from the central axes 122 and 110 at least a distance 152 that is greater than the radial distance the water bottle cap 106 (e.g., the cap body 120) and the water bottle body 104 extend from the central axes 110 and 122.

In some embodiments, a cushion layer 154 is applied to the top surface 144 of the platform 108 to provide a comfortable surface for sitting. The cushion layer 154 may include foam or another suitable cushioning material that may be covered with a durable coating or layer for resisting abrasion, water, and other environmental conditions.

In some embodiments, the platform 108 may include one or more openings that are suitable for various purposes. In one example, the seat platform 108 includes a handle 156 formed by a handle opening 158 through the seat platform 108, as shown in FIGS. 1-4. The handle 156 may be formed by a perimeter portion 160 that defines a boundary of the handling opening 158, as shown in FIGS. 2-3.

Another embodiment of the seat platform 108 includes an opening 162 (FIGS. 1-3) that may be formed smaller than the handle opening 158. The opening 162 may be configured to receive a carabiner, a strap 164 (FIG. 1), or another item.

The seat platform 108 may be removably or non-removably attached to the cap body 120, in a manner that ensures that the assembled seat 100 may be used in accordance with its intended purpose. As used herein, the "removable attachment" of the seat platform 108 to the cap body 120 means that the seat platform 108 may be connected or secured to the cap body 120 and disconnected from the cap body 120 by hand and without the use of tools, and the "non-removable attachment" of the seat platform 108 to the cap body 120 means that the connection between the seat platform 108 and the cap body 120 is one that generally prevents the disconnection of the components by hand, thus requiring the use of tools to disassemble the seat platform 108 from the cap body 120.

Examples of connections facilitating the non-removable attachment of the seat platform 108 to the cap body 120 include adhering the cap body 120 to the seat platform 108 using an adhesive, forming the seat platform 108 and the cap body 120 as an integrated component, welding the cap body 120 to the seat platform 108, and other similar connections. When the water bottle cap 130 or cap body 120 is non-removably attached to the seat platform 108, the seat 100 may be formed by screwing the cap body 120 and the connected platform 108 to the top 116 of the water bottle body 104, for example.

The removable attachment of the seat platform 108 to the water bottle cap 106 or the cap body 120 allows the water bottle 102 to take on a more conventional form and be used in a conventional manner to store a liquid for periodic consumption, while the seat platform 108 may be carried separately, such as stowed in a disc carrier, for example. When the user desires to sit down, the user may quickly attach the seat platform 108 to the water bottle cap body 120 and use the assembled seat to sit above the ground 166 (FIG. 1).

In some embodiments, the cap body 120 includes a connector 170 and the seat platform 108 includes a connector 172. The connectors 170 and 172 cooperate with each other to form a removable connection 174 between the cap body 120 and the seat platform 108. The connection formed by the connectors 170 and 172 generally secures the platform 108 to the cap body 120 such that the platform 108 will not disconnect from the cap body 120 during normal use, such as while one sits on the platform 108 and/or carries the assembled water bottle seat 100 using the handle 156, for example, while allowing a user to detach the seat platform 108 from the cap body 120 by hand. The connectors 170 and 172 may take on any suitable form.

Figure 11:
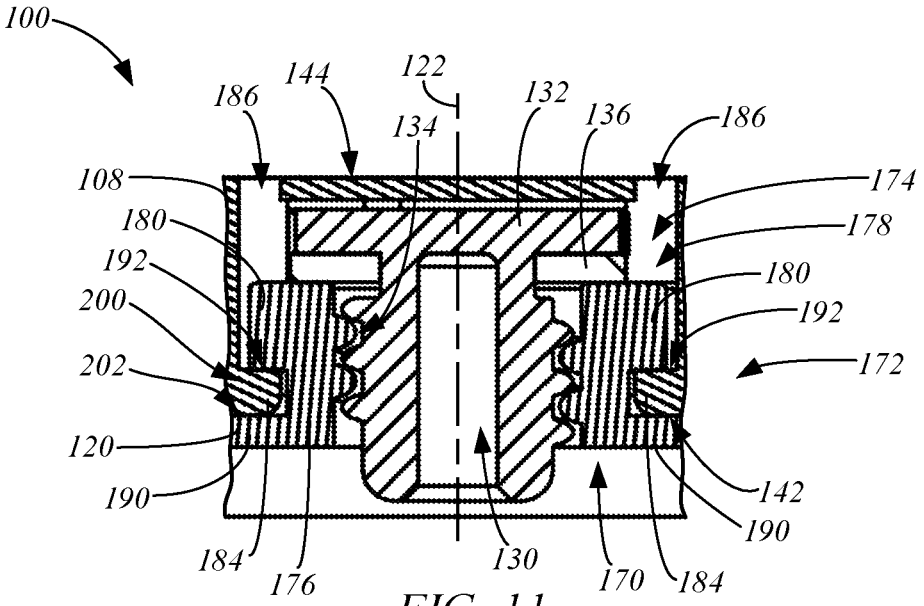
FIG. 11 is a magnified side cross-sectional view of a central portion of the water bottle seat of FIG. 2 taken generally along line 11-11, in accordance with embodiments of the present disclosure.
Figure 12:
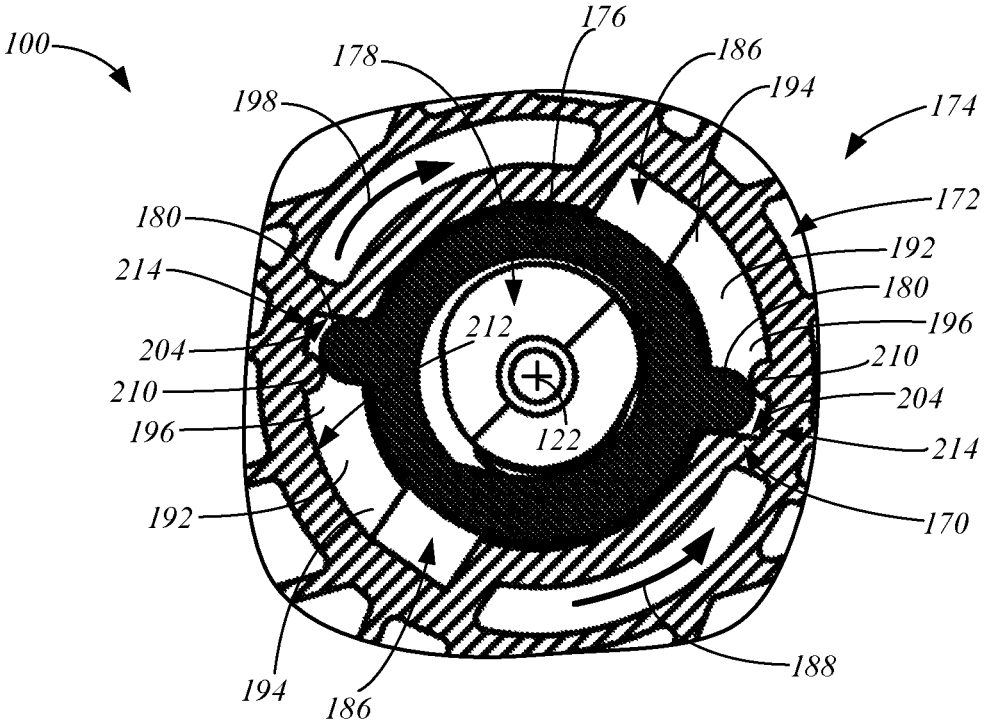
FIG. 12 is a magnified bottom cross-sectional view of a central portion of the water bottle seat of FIG. 5 taken generally along line 12-12, in accordance with embodiments of the present disclosure.

Some examples of the connectors 170 and 172 will be described with reference to FIGS. 11 and 12. FIG. 11 is a magnified side cross-sectional view of a central portion of the water bottle seat 100 of FIG. 2 taken generally along line 11-11, and FIG. 12 is a magnified bottom cross-sectional view of a central portion of the water bottle seat 100 of FIG. 5 taken generally along line 12-12, in accordance with embodiments of the present disclosure.

In one embodiment, the cap body 120 includes a central projection 176 extending along the central axis 122, which may form a portion of the connector 170, as shown in FIGS. 6-8 and 11. The fluid pathway 130 may extend through the central projection 176, which may optionally include the threaded opening 134 for receiving the plug 132, as discussed above.

The seat platform 108 may include a receptacle 178 (FIG. 9) that forms a portion of the connector 172. The receptacle 178 is formed in the bottom side 142 of the platform 108 and extends toward the top side 144 of the platform 108. In some embodiments, the receptacle 178 is configured to receive at least a portion of the central projection including the plug, as shown in FIG. 11. Since a central axis of the receptacle 178 is generally aligned with the central axis 122 of the cap body 120 and the central projection 176 when the components are assembled together, features of the connector of the seat platform 108 will be described with reference to the central axis 122 of the cap body 120.

In accordance with another embodiment, the connector 170 of the cap body 120 includes at least one tab or connector projection 180 extending radially from the central projection 176 relative to the central axis, as shown in FIG. 7, and the connector 172 of the seat platform 108 includes at least one keyed opening 182 extending radially from the receptacle 178, as shown in FIG. 9. The receptacle 178 and the keyed opening 182 are respectively configured to receive the portion of the central projection 176 and the connector projection 180 when the seat platform 108 and the cap body 120 are properly oriented relative to each other about the central axis 122.

The connector 170 may comprise 1-4 connector projections 180, and the connector 172 may include a corresponding number of keyed openings 182. In one embodiment, the connector 170 of the cap body 120 includes a pair of the connector projections 180 that extend in opposite directions, as shown in FIGS. 6 and 7, and the connector 172 of the seat platform 108 includes a pair of keyed openings 182 (FIG. 9) that are configured to receive the connector projections 180 when the seat platform 108 and the cap body 120 are properly oriented relative to each other about the central axis 122.

In one embodiment, the connector 172 of the seat platform 108 includes a shoulder 184 at the bottom side 142 for each of the keyed openings 182, as shown in FIGS. 9-11. Each shoulder extends angularly from the corresponding keyed opening 182 about the central axis 122. In the example shown in FIG. 9, the seat platform 108 includes a pair of shoulders 184, which are each configured to accommodate one of the connector projections 180.

To connect the seat platform 108 to the cap body 120, the central projection 176 must be aligned with the receptacle 178 and each of the connector projections 180 must be angularly aligned about the central axis 122 with a corresponding one of the keyed openings 182. In one embodiment, the seat platform 108 includes an opening 186 in the top side 144 for each of the keyed openings 182 in the bottom side 142, as shown in FIGS. 2 and 4. The openings 186 operate as see-throughs to expose the keyed openings 182 and make it easier for a user to angularly align the connector projections 180 with the keyed openings 182 when attaching the seat platform 108 to the cap body 120.

Once properly aligned, the seat platform 108 is then moved along the central axis 122 relative to the cap body 120 such that the top portion of the central projection 176 is received within the receptacle 178, and the connector projections 180 pass through the keyed openings 182 such that they are positioned above the bottom side 142 of the seat platform 108. The seat platform 108 is then rotated about the central axis 122 relative to the cap body 120, such as in a clockwise direction (when viewed from the top) as indicated by arrow 188 in FIG. 12. This positions the shoulders 184 between the connector projections 180 and a portion 190 of the cap body 120, as shown in FIG. 11, and attaches the seat platform 108 to the cap body 120, such that it is inhibited from traveling along the central axis 122 relative to the cap body 120. The seat platform 108 may be detached from the cap body 120 by reversing the steps described above.

It may be desirable to pinch the bottom side 142 of the seat platform 108 between the connector projections 180 and the cap body 120 to stabilize the seat platform 108 (e.g., eliminate wobble) relative to the cap body 120. In one embodiment, each shoulder 184 includes a ramp 192 having an end 194 adjacent the keyed opening 182 and an end 196 that is angularly displaced from the end 194 about the central axis 122, as shown in FIGS. 10 and 12. Each ramp 192 has a thickness (FIG. 10), which is measured along the central axis 122 from the bottom side 142 of the seat platform 108 toward the top side 144, that increases with angular displacement in the direction of arrow 198 (FIG. 12) about the central axis 122 from the end 194 to the end 196.

After the central projection 176 is received within the receptacle 178 and the one or more connector projections 180 are passed through the keyed openings 182, the connector projections 180 are driven along the ramps 192 from the end 194 to the end 196 as the seat platform 108 is rotated about the central axis 122 in the direction of arrow 188 relative to the cap body 120, as indicated in FIG. 12. During this rotation, a gap 200 (FIGS. 7 and 11) between the surface 202 of the portion 190 of the cap body 120 and the connector projection 180 is filled by the corresponding shoulder 184 due to its increasing thickness. As a result, the shoulders 184 of the seat platform 108 are each squeezed between the corresponding connector projection 180 and the portion 190 of the cap body 120. Engagement between the bottom side 142 of the seat platform 108 and the cap body 120 operates to stabilize the seat platform 108 (e.g., prevent wobble).

In one embodiment, when the seat platform 108 is rotated about the axis 122 during assembly of the seat 100, each connector projection 180 is driven along the corresponding ramp 192 as discussed above. This rotation may cause the connector projection 180 to abut an end wall 204, shown in FIGS. 10 and 12, which prevents further rotation of the seat platform 108 relative to the cap body 120. A platform 206 may extend between the end wall 204 and the end 196 of the ramp, as shown in FIG. 10.

While friction between the cap body 120 and the seat platform 108 resists rotation of the seat platform 108 about the central axis 122 relative to the cap body 120, it may be desirable to provide additional measures to prevent the seat platform 108 from rotating relative to the cap body 120 after its attachment, such as while sitting on the seat 100, and during normal handling (e.g., carrying, etc.) of the assembled seat 100. In one embodiment, the seat platform 108 includes a locking protuberance and/or a locking detent corresponding to one or more of the shoulders 184 that operates to engage one of the connector projections 180 and resist rotation of the seat platform 108 relative to the cap body 120 that could cause unintentional detachment of the seat platform 108 from the cap body 120.

One example of a locking protuberance is shown in FIG. 10. In this example, the locking protuberance 210 extends vertically along an interior wall 212 between the end 196 of the ramp 192 and the end wall 204, as shown in FIG. 10. When the connector protrusion 180 slides up the ramp 192 and engages the protuberance 210 during rotation of the seat platform 108 relative to the cap body 120, the protuberance 210 creates an increase in rotational resistance, which must be overcome through the application of additional rotational force to the seat platform 108 to further drive the connector projection 180 past the protuberance 210 and against the end wall 204 to complete the assembly of the seat 100. As the connector projection 180 is rotated past the protuberance 210, a "snap" may be sensed by the user indicating that the seat platform 108 is fully secured to the cap body 120.

A gap 214 (FIG. 10) between the end wall 204 and the protuberance 210 may be provided that is generally sufficient to accommodate the connector projection 180 such that the connector projection 180 simultaneously engages both the end wall 204 and the protuberance 210 when it is positioned in the gap 214, as shown in FIG. 12. As a result, when the seat 100 is assembled, the resistance to rotation of the seat platform 108 relative to the cap body 120 caused by the engagement between the protuberance 210 and the connector projection 180 inhibits the seat platform 108 from unintentionally rotating relative to the cap body 120, such as while sitting on the seat 100 or carrying the seat 100, for example. However, this resistance may be overcome by hand when it is desired to detach the seat platform 108 from the cap body 120.

An example of a locking detent 216 is drawn in phantom lines in FIG. 10 and may be formed within the wall 212 or the platform 206. The locking detent 216 is configured to receive the connector projection 180 when the seat is fully assembled. The engagement of the connector projection 180 with the detent 216 inhibits the seat platform 108 from unintentionally rotating relative to the cap body 120. In one option, both the protuberance 210 and the detent 214 are used to inhibit unintentional rotation of the seat platform 108 relative to the cap body 120.

The connection 174 formed by cooperating portions or components 170 and 172 of the cap body 120 and the platform 108 may include components 220 (FIG. 1) that are magnetically attracted to each other. For example, the components 220 may comprise one or more magnets and/or ferromagnetic materials to form the connection 174 or a portion thereof and removably attach the seat platform 108 to the cap body 120.

Figure 13:
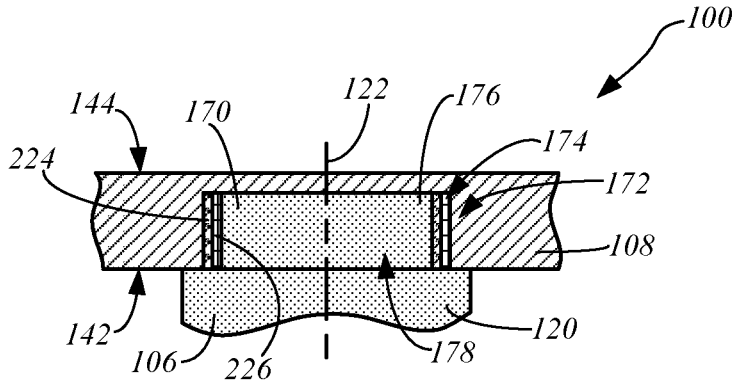
FIGS. 13-15 are simplified side cross-sectional views illustrating examples of a connection formed between a seat platform and a cap body, in accordance with embodiments of the present disclosure.
Figure 14:
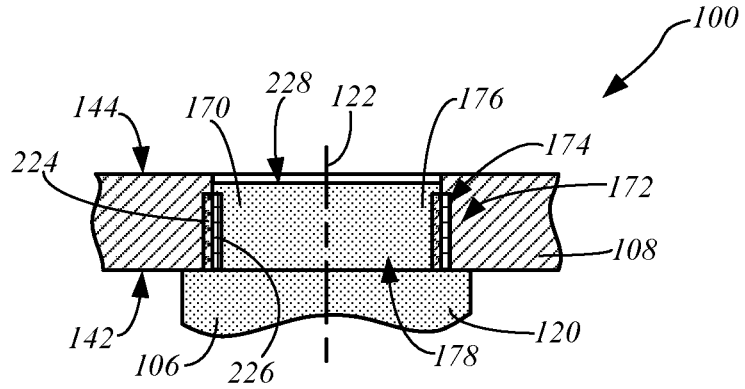
Figure 15:
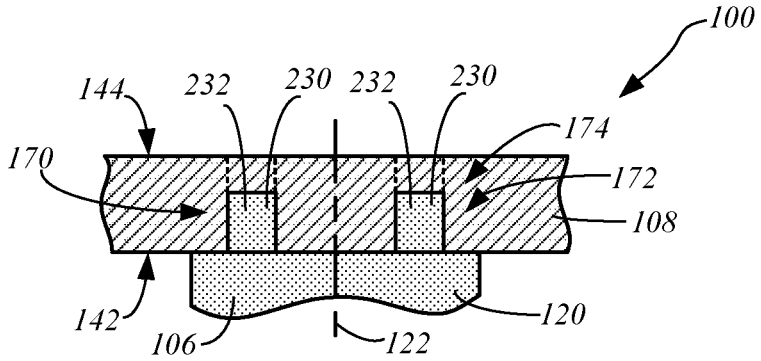

FIGS. 13-15 are simplified side cross-sectional views illustrating additional embodiments of the connectors 170 and 172 that form the connection 174 between the seat platform 108 and the cap body 120, in accordance with embodiments of the present disclosure. In one example, the connector 170 comprises a threaded outer surface 224 of the central projection 176 and the connector 172 comprises a threaded inner surface 226 of the receptacle 178, as indicated in FIGS. 13 and 14. This allows the platform 108 to be screwed to the central projection 176 by rotating the platform 108 about the central axis 122 relative to the cap body 120.

Alternatively, the surfaces 224 and 226 may be configured to have a press-fit or frictional-fit interface to secure the seat platform 108 to the cap body 120. Here, an opening to the receptacle 178 may be formed in the top surface 144 of the seat platform to relieve air pressure during assembly.

In one embodiment, the receptacle 178 extends through both the bottom side 142 and the top side 144 of the seat platform 108, as shown in FIG. 14. This allows the user to see through the seat platform 108 while attempting to place the central projection 176 into the receptacle 178. In one embodiment, the top of the central projection 176 or the water bottle cap 106 is exposed from the top side 144 of the seat platform 108 along the central axis 122 when the seat 100 is fully assembled. This allows for the accommodation of features of the water bottle cap 106, such an access port (e.g., flip-up port), and may allow for their use while the seat 100 is fully assembled.

In one embodiment, the connector 172 of the platform 108 includes two or more apertures or sockets 230 (hereinafter "sockets") and the connector 170 of the cap body 120 includes corresponding projections 232 that extend from the cap body 120 along the central axis 122, as shown in FIG. 15. The sockets 230 receive the projections 232 to form the connection 174. The one or more sockets 230 may only be open to the bottom side 142 of the platform 108. As a result, the top surface 144 of the platform 108 may be a substantially continuous surface in the central region of the platform 108. Alternatively, the sockets 230 may extend through the platform 108, as indicated in phantom lines, to allow a user to see through to the bottom side 142 of the seat platform 108 and simplify assembly.

In some embodiments, the connection 174 formed by the sockets 230 and the projections 232 provides a snap-fit connection similar to that provided by the protuberance 210 or the detent 216 discussed above. Thus, a user simply orients the platform 108 relative to the water bottle 102 such that its one or more projections 232 are received within the corresponding one or more sockets 230 and presses the platform 108 along the central axis 122 to snap the one or more projections 232 into the corresponding sockets 230. In some embodiments, frictional interference between the sockets 230 and the projections 232 secures the platform 108 to the water bottle cap 106, as well as to a water bottle body 104 connected to the cap 106 and completes the assembly of the seat 100.

Although the embodiments of the present disclosure have been described with reference to preferred embodiments, workers skilled in the art will recognize that changes may be made in form and detail without departing from the spirit and scope of the present disclosure.

What is claimed is:

1. A water bottle seat comprising:

a water bottle cap including a cap body configured to attach to a water bottle body, the cap body having a central axis; and a seat platform attached to the cap body and configured to support a user seated thereon when the water bottle cap is attached to the water bottle body, wherein: the water bottle body has a diameter of less than 5.0 inches;

the cap body is positioned at a center of the seat platform;

the seat platform extends in a plane that is transverse to the central axis; and the seat platform extends radially from the central axis a greater distance than the water bottle cap and at least 3-6 inches from the central axis.

2. The water bottle seat of claim 1, wherein:

the cap body includes a first connector; and the seat platform includes a second connector that is configured to cooperate with the first connector to attach the seat platform to the cap body.

3. The water bottle seat according to claim 2, wherein:

the water bottle cap includes a central projection extending along the central axis; and the second connector includes a receptacle formed in a bottom side of the seat platform and extending toward a top side of the seat platform, the receptacle configured to receive a portion of the central projection.

4. The water bottle seat according to claim 3, wherein:

the water bottle seat comprises a water bottle body having an interior cavity, a bottom end, a top end opposite the bottom end, and a cavity opening to the interior cavity at the top end; and the cap body is removably attachable to the top end of the water bottle body and is configured to cover the cavity opening.

5. The water bottle seat according to claim 4, wherein:

a fluid passageway extends through the cap body and the central projection, wherein the fluid passageway provides access to the cavity opening and the interior cavity of the water bottle body; and the cap includes a plug removably attached to the cap body and configured to seal the cap opening.

6. The water bottle seat according to claim 5, wherein the seat platform extends over the plug when the seat platform is attached to the cap using the first and second connectors.

7. The water bottle seat according to claim 1, wherein the seat platform is circular and has a diameter of 6-11 inches.

8. The water bottle seat according to claim 7, wherein the seat platform includes a handle formed by a handle opening through the seat platform and a perimeter portion of the seat platform, which defines a boundary to the handle opening.

9. The water bottle seat according to claim 3, wherein:

the first connector comprises a connector projection extending radially from the central projection relative to the central axis; and the second connector includes a keyed opening extending radially from the receptacle, wherein the receptacle and the keyed opening are respectively configured to receive the portion of the central projection and the connector projection.

10. The water bottle seat according to claim 9, wherein the seat platform includes an opening in the top side extending to the keyed opening in the bottom side.

11. The water bottle seat according to claim 9, wherein:

the second connector includes a shoulder at the bottom side of the seat platform that extends angularly from the keyed opening about the central axis; and insertion of the central projection and the connector projection respectively through the receptacle and the keyed opening, and rotation of the seat platform relative to the water bottle cap in a first direction about the central axis positions the shoulder between the connector projection and the cap body.

12. The water bottle seat according to claim 11, wherein:

the shoulder includes a ramp having a first end that is adjacent the keyed opening and a second end that is angularly displaced from the first end about the central axis;

the ramp has a thickness measured from the bottom side toward the top side that increases with angular displacement about the central axis from the first end toward the second end; and insertion of the central projection and the connector projection through the receptacle and the keyed opening and rotation of the seat platform relative to the cap in the first direction about the central axis squeezes the shoulder between the connector projection and the cap body.

13. The water bottle seat according to claim 11, wherein the second connector includes a locking protuberance or a locking detent that engages the connector projection and frictionally resists angular rotation of the seat platform relative to the cap in a second direction about the central axis that is opposite the first direction.

14. The water bottle seat according to claim 11, wherein:

the connector projection is a first connector projection;

the first connector includes a second connector projection extending radially from the central projection;

the shoulder is a first shoulder;

the keyed opening is a first keyed opening;

the second connector includes a second keyed opening extending radially from the receptacle relative to the central axis;

the second connector includes a second shoulder at the bottom side of the seat platform that extends angularly from the second keyed opening about the central axis; and insertion of the central projection, the first connector projection, and the second connector projection respectively through the receptacle, the first keyed opening and the second keyed opening, and rotation of the seat platform relative to the cap in a first direction about the central axis positions the first shoulder between the first connector projection and the cap body and the second shoulder between the second connector projection and the cap body.

15. The water bottle seat according to claim 14, wherein the seat platform includes a first opening in the top side extending to the first keyed opening in the bottom side, and a second opening in the top side extending to the second keyed opening in the bottom side.

16. The water bottle seat according to claim 14, wherein:

the first shoulder includes a ramp having a first end adjacent the first keyed opening and a second end that is angularly displaced from the first end about the central axis;

the second shoulder includes a ramp having a first end adjacent the second keyed opening and a second end that is angularly displaced from the first end about the central axis;

each of the ramps has a thickness measured from the bottom side toward the top side that increases with angular displacement about the central axis from the first end of the ramp toward the second end of the ramp; and insertion of the central projection, the first connector projection and the second connector projection respectively through the receptacle, the first keyed opening and the second keyed opening, and rotation of the seat platform relative to the water bottle cap in the first direction about the central axis squeezes the first shoulder between the first connector projection and the cap body and squeezes the second shoulder between the first connector projection and the cap body.

17. The water bottle seat according to claim 14, wherein the second connector includes a pair of locking protuberances or locking detents, each of which is configured to engage one of the first and second connector projections and frictionally resists angular rotation of the seat platform relative to the cap in a second direction about the central axis that is opposite the first direction.

18. The water bottle seat according to claim 14, wherein the first and second connector projections extend in opposite directions from the central projection.

19. The water bottle seat according to claim 2, wherein the first and second connectors are magnetically attracted to each other.

20. The water bottle seat according to claim 2, wherein:

the first connector includes at least two projections, each extending along the central axis from the cap body; and the second connector includes at least two receptacles formed in a bottom side of the seat platform, each configured to receive one of the at least two projections to attach the seat platform to the water bottle cap.

21. The water bottle seat according to claim 3, wherein:

the central projection includes a threaded exterior surface;

the receptacle includes a threaded interior surface; and the threaded exterior surface and the threaded interior surface cooperate to inhibit movement of the seat platform along the central axis relative to the water bottle cap.

22. A water bottle seat comprising:

a water bottle body having an interior cavity, a bottom end, a top end opposite the bottom end, a cavity opening to the interior cavity at the top end, and a central axis;

a water bottle cap including a cap body that is removably attachable to the top end of the water bottle body adjacent the cavity opening and has a central axis that is coaxial to the central axis of the water bottle body when attached to the water bottle body; and a seat platform attached to the water bottle cap and configured to support a user seated thereon when the water bottle cap is attached to the water bottle body, wherein: the water bottle body has a diameter of less than 5.0 inches;

the cap body is positioned at a center of the seat platform;

the seat platform extends in a plane that is transverse to the central axis of the water bottle cap; and the seat platform extends radially from the central axis of the water bottle cap a greater distance than the water bottle cap and at least 3-6 inches from the central axis of the water bottle cap.

23. A method of assembling a water bottle seat, which includes:

a water bottle body having a diameter of less than 5.0 inches; including an interior cavity, a bottom end, a top end opposite the bottom end, a cavity opening to the interior cavity, and a central axis;

a water bottle cap comprising a cap body having a central axis; and a circular seat platform attached to the water bottle cap, the method comprising attaching the water bottle cap to the top end of the water bottle body wherein:

the cap body is positioned at a center of the seat platform;

the central axis of the cap body is coaxial to the central axis of the water bottle body;

the seat platform is configured to support a person seated thereon;

the seat platform extends in a plane that is transverse to a central axis of the cap body; and the seat platform extends radially from the central axis of the cap body a distance of at least 3-6 inches, which is greater than a radial distance that the water bottle body and the water bottle cap extend from the central axis of the cap body.

* * * * *